US009935348B2

(12) United States Patent
Yu et al.

(10) Patent No.: US 9,935,348 B2
(45) Date of Patent: Apr. 3, 2018

(54) TM DIELECTRIC RESONATOR, METHOD FOR IMPLEMENTING TM DIELECTRIC RESONATOR AND TM DIELECTRIC FILTER

(71) Applicant: ZTE CORPORATION, Shenzhen, Guangdong Province (CN)

(72) Inventors: Wanli Yu, Shenzhen (CN); Yulong Kang, Shenzhen (CN); Xiaowen Dai, Shenzhen (CN)

(73) Assignee: ZTE CORPORATION, Shenzhen, Guangdong Province (CN)

( * ) Notice: Subject to any disclaimer, the term of this patent is extended or adjusted under 35 U.S.C. 154(b) by 114 days.

(21) Appl. No.: 14/651,978

(22) PCT Filed: Oct. 10, 2013

(86) PCT No.: PCT/CN2013/084994
§ 371 (c)(1),
(2) Date: Jun. 12, 2015

(87) PCT Pub. No.: WO2014/090031
PCT Pub. Date: Jun. 19, 2014

(65) Prior Publication Data

US 2015/0325902 A1 Nov. 12, 2015

(30) Foreign Application Priority Data

Dec. 14, 2012 (CN) ..... 2012 1 0544036

(51) Int. Cl.
*H01P 1/208* (2006.01)
*H01P 11/00* (2006.01)
(Continued)

(52) U.S. Cl.
CPC ..... *H01P 1/2084* (2013.01); *H01P 1/201* (2013.01); *H01P 1/2002* (2013.01); *H01P 7/10* (2013.01);
(Continued)

(58) Field of Classification Search
CPC ..... H01P 7/10; H01P 1/2048; H01P 11/008; H01P 1/2084; Y10T 29/49018
(Continued)

(56) References Cited

U.S. PATENT DOCUMENTS 4,639,699 A * 1/1987 Nishikawa ..... H01P 7/10 333/202
2011/0128097 A1* 6/2011 Park ..... H01P 7/10 333/219.1

FOREIGN PATENT DOCUMENTS

CN 201725860 U 1/2011
CN 201749933 U 2/2011
(Continued)

OTHER PUBLICATIONS

Du. et al., "Wireless Communications Systems", Cambridge University Press, NY, 2010, pp. 407.*
(Continued)

*Primary Examiner* — Benny Lee
*Assistant Examiner* — Hafizur Rahman
(74) *Attorney, Agent, or Firm* — Koppel, Patrick, Heybl & Philpott

(57) ABSTRACT

A method for implementing a TM dielectric resonator is provided, which includes: a dielectric resonant column component with a metal connecting plate is machined; a metal cavity with an opening at one end is machined; the metal connection plate of the dielectric resonant column component is fastened to the inner wall of the metal cavity by a screw; the opening of the metal cavity is covered with a prefabricated cover plate; and a prefabricated tuning screw is screwed from the cover plate into the metal cavity.

3 Claims, 4 Drawing Sheets

(51) Int. Cl.
*H01P 1/20* (2006.01)
*H01P 1/201* (2006.01)
*H01P 7/10* (2006.01)

(52) U.S. Cl.
CPC ..... *H01P 11/008* (2013.01); *Y10T 29/49018* (2015.01)

(58) Field of Classification Search
USPC ..... 333/212
See application file for complete search history.

(56) References Cited

FOREIGN PATENT DOCUMENTS

| | | | | |
|---|---|---|---|---|
| CN | 201985225 | U | 9/2011 | |
| CN | 103022627 | A | 4/2013 | |
| WO | WO 2011113279 | A1 * | 9/2011 | ..... H01P 1/2084 |

OTHER PUBLICATIONS

International Search Report (Form PCT/ISA/210) for PCT/CN2013/084994 dated Jan. 9, 2014.

* cited by examiner

TM DIELECTRIC RESONATOR, METHOD FOR IMPLEMENTING TM DIELECTRIC RESONATOR AND TM DIELECTRIC FILTER

TECHNICAL FIELD

The present invention relates to the technical field of communications, in particular to a TM dielectric resonator, a method for implementing the TM dielectric resonator and a TM dielectric filter.

BACKGROUND

According to the characteristics that the wave length of electromagnetic wave may be shortened when the electromagnetic wave travels in high dielectric constant substances, a traditional metal material can be replaced with a dielectric material; and under a same index, the volume of a filter may be decreased. The research for the dielectric filter is a hot point in the communication industry all the time. As an important component of a wireless communication product, the dielectric filter is very significant for the miniaturization of a communication product.

As shown in FIG. 1, generally, a TM mode dielectric resonator mainly includes a dielectric resonant column 103, a sealing cover plate 102, a tuning screw 101 and a metal cavity 104. The lower surface of the dielectric resonant column 103 is directly welded on the metal cavity 104 and is used for tightly contacting with the bottom surface of the metal cavity; and the sealing cover plate 102 is sealed with the metal cavity 104 through a screw to form a sealing cavity. When the dielectric resonator runs normally, high electric field is distributed at the joint part between the lower end surface of the dielectric resonant column 103 and the metal cavity 104. Because the dielectric resonant column is directly welded at the bottom of the metal cavity, when the lower end surface of the dielectric resonant column does not fully contact with the metal cavity, the impedance may become discontinuous, the field energy cannot be transmitted out, the high dielectric constant and high quality factor of the dielectric resonant column cannot be shown, and even media may be burnt up. Therefore, a very high requirement is set to the process of welding the dielectric resonant column with the metal cavity into a whole; in addition, the shedding phenomenon in the processing of welding the dielectric resonant column with the metal cavity may affect the performance and the service life of the dielectric resonator seriously. Therefore, whether the lower surface of the dielectric resonant column contacts with the surface of the metal cavity well in the TM mode dielectric resonator is very critical, and how to solve the problems of fixation and contact for the TM mode dielectric resonant column becomes a key research direction for the application of the dielectric resonator.

In a Chinese patent CN201020643211, a TM mode dielectric filter is described, which includes a metal resonant cavity, a cover plate, a tuning screw and a TM mode dielectric resonator, wherein the TM mode dielectric resonator is fixed inside the metal resonant cavity through a screw. The TM mode dielectric filter is characterized in that the screw rod part of the screw passes through a location hole of the TM mode dielectric resonator to be tightly screwed at the bottom or on a side wall of the metal resonant cavity; the screw rod part of the screw does not contact with the location hole; and a transition gasket is arranged between the head part of the screw and the location hole end surface of the TM mode dielectric resonator to separate them. The specific implementation process in the patent is complex in assembly process, and has a high requirement on the structure design and a great influence on the performance, so as to be unfavourable for batch production and cause a high production cost.

SUMMARY

In view of this, the objective of an embodiment of the present invention is to provide a method for implementing a TM dielectric resonator. The machining process is simple, and the machined TM dielectric resonator is small in volume, excellent in performance and high in operational reliability. An embodiment of the present invention further provides a TM dielectric resonator machined by the method above and a dielectric filter formed by one or more TM dielectric resonators.

To implement the objective above, an embodiment of the present invention provides the method for implementing the TM dielectric resonator, which includes the following steps:

a dielectric resonant column component with a metal connecting plate is machined;

a metal cavity with an opening at one end is machined;

the metal connection plate of the dielectric resonant column component is fastened to the inner wall of the metal cavity by a screw;

the opening of the metal cavity is covered with a prefabricated cover plate; and a prefabricated tuning screw is screwed from the cover plate into the metal cavity.

The step that a dielectric resonant column component with a metal connecting plate is machined may include:

one end of a prefabricated cylindrical dielectric resonant column is metalized;

an annular groove and a first circular groove are machined on the upper end surface and the lower end surface of a prefabricated disc-shaped metal connecting plate respectively; and the metalized end of the dielectric resonant column is placed in the annular groove and is welded with the metal connecting plate into a whole.

Preferably, a second circular groove is machined on the inner wall of the metal cavity and matches the lower end surface of the metal connecting plate.

Or, the step that a dielectric resonant column component with a metal connecting plate is machined may include:

one end of a prefabricated cylindrical dielectric resonant column is metalized;

a cylindrical boss which matches the inner surface of the dielectric resonant column is machined on the upper end surface of the prefabricated disc-shaped metal connecting plate; and the metalized end of the dielectric resonant column is sleeved on the outer surface of the cylindrical boss and is welded with the metal connecting plate into a whole.

Preferably, a cavity groove is machined on the inner wall of the metal cavity and matches the metal connecting plate.

Preferably, a threaded hole which matches the screw is further machined on the inner wall of the metal cavity.

An embodiment of the present invention further provides a TM dielectric resonator machined according to the method above, which includes a metal cavity with an opening at one end, a dielectric resonant column component which is provided with a metal connecting plate and is arranged in the metal cavity, a screw which fastens the dielectric resonant column component to the inner wall of the metal cavity, a cover plate which covers the opening end of the metal cavity to seal the inner part of the metal cavity, and a tuning screw which is screwed from the cover plate into the metal cavity.

The dielectric resonant column component with the metal connecting plate includes: a disc-shaped metal connecting plate on the upper end surface and the lower end surface of which an annular groove and a first circular groove are formed respectively, and a cylindrical dielectric resonant column welded inside the annular groove, wherein one end of the dielectric resonant column contacting with the metal connecting plate is metalized.

Or, the dielectric resonant column component with the metal connecting plate includes: a disc-shaped metal connecting plate on the upper end surface of which a cylindrical boss is formed, and a dielectric resonant column which is sleeved on the outer surface of the cylindrical boss and is welded with the metal connecting plate into a whole, wherein one end of the dielectric resonant column contacting with the metal connecting plate is metalized.

An embodiment of the present invention further provides a TM dielectric filter, which includes one or more TM dielectric resonators.

Compared with the prior art, the method for implementing the TM dielectric resonator in the embodiment of the present invention has the following advantages:

1) The dielectric resonant column component with the metal connecting plate is fastened to the inner wall of the metal cavity by a screw, so that the machining process is simplified, the dielectric resonant column component fully contacts with the metal cavity, the effective transmission of the field energy of the dielectric resonant column component is ensured and the performance and the operational reliability of the TM dielectric resonator are improved.

2) The dielectric resonant column component is formed by welding the metalized end of the dielectric resonant column with the metal connecting plate, and the welding can be carried out outside the metal cavity, so that the welding process is simple and easy to implement, which is favourable for batch production and reduces the production cost.

3) The dielectric resonant column in the dielectric resonant column component is firmly welded with the metal connecting plate to ensure that they contact well under external force and in the conveying process, so that the performance and the service life of the TM dielectric resonator are improved, and the volume of the resonator and the filter is reduced effectively.

The embodiments are further described below with reference to the accompanying drawings.

Description of reference numbers: 1-tuning screw, 2-cover plate, 3-dielectric resonant column, 4-metal cavity, 5-screw, 6-metal connecting plate, 41-second circular groove, 42-threaded hole, 61-annular groove, 62-first circular groove, 63-cylindrical boss, and 64-threaded through hole.

DETAILED DESCRIPTION OF THE EMBODIMENTS

Figure 1:
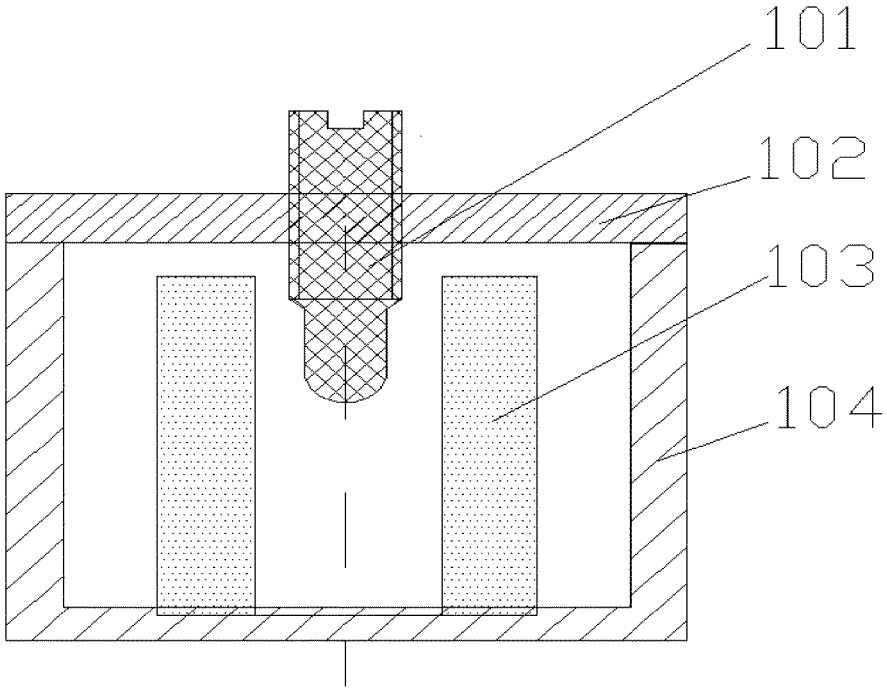
Fig.1 (Prior Art)
FIG. 1 is a diagram showing the structure of a TM dielectric resonator in the prior art.
Figure 2:
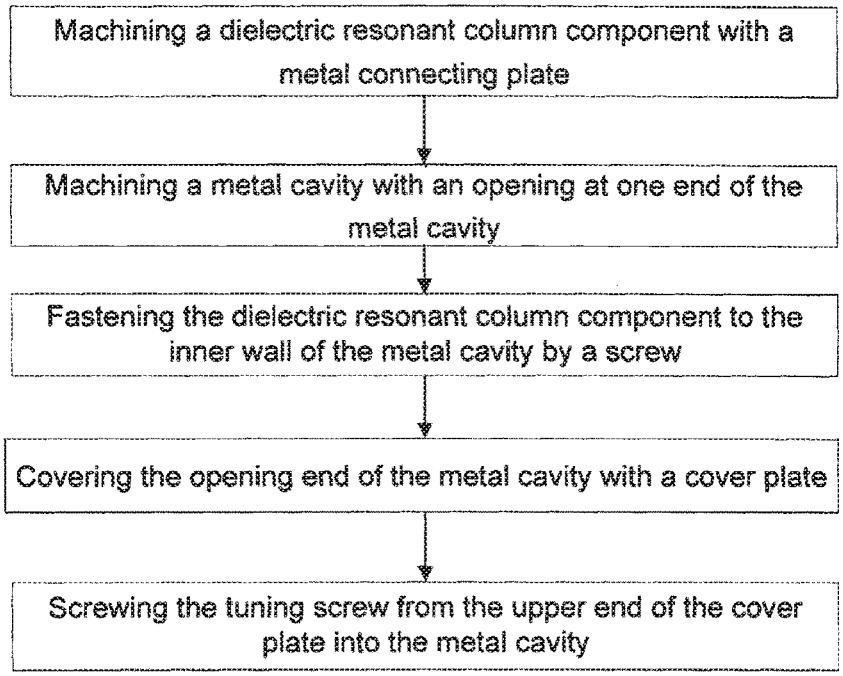
FIG. 2 is a diagram showing the machining process of a method for implementing a TM dielectric resonator in an embodiment of the present invention.

As shown in FIG. 2, the method for implementing a TM dielectric resonator in an embodiment of the present invention includes the following steps:

a dielectric resonant column component with a metal connecting plate is machined;

a metal cavity 4 with an opening at one end is machined;

the metal connection plate of the dielectric resonant column component is fastened to the inner wall of the metal cavity 4 by a screw 5;

the opening of the metal cavity 4 is covered with a prefabricated cover plate 2; and a prefabricated tuning screw 1 is screwed from the cover plate 2 into the metal cavity 4.

Preferably, in the embodiment of the present invention, a dielectric resonant column component with a metal connecting plate is machined; a metal cavity with an opening at one end is machined; the metal connection plate of the dielectric resonant column component is fastened to the inner wall of the bottom of the metal cavity 4 opposite to the opening end by a screw 5; the opening end of the metal cavity 4 is covered with a prefabricated cover plate 2; and a prefabricated tuning screw 1 is screwed from the upper part of the cover plate 2 into the metal cavity for a certain length, so as to form a sealed TM dielectric resonator.

In the method for implementing the TM dielectric resonator, the dielectric resonant column component with the metal connecting plate is machined by different methods, and TM dielectric resonators and TM dielectric filters of different structures are machined. The method is described below in combination with specific embodiments in detail.

Embodiment 1

In the embodiment, the step that a dielectric resonant column component with a metal connecting plate is machined may include:

one end of a prefabricated cylindrical dielectric resonant column 3 is metalized;

an annular groove 61 and a first circular groove 62 are machined on the upper end surface and the lower end surface of a prefabricated disc-shaped metal connecting plate 6 respectively; and the metalized end of the dielectric resonant column 3 is placed in the annular groove 61 and is welded with the metal connecting plate 6 into a whole.

Preferably, when the dielectric resonant column component with the metal connecting plate is machined, one end of the prefabricated cylindrical dielectric resonant column 3 needs to be metalized. During the metallization, a metal film may be coated at one end of the dielectric resonant column 3 by an electroplating method or in other methods in the prior art.

Figure 4:
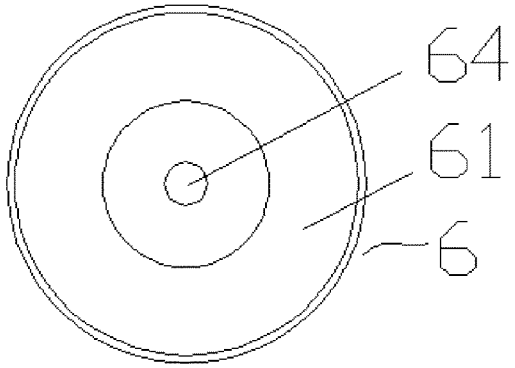
FIG. 4 is a diagram showing the structure of a metal connecting plate in a first embodiment of the present invention.
Figure 5:
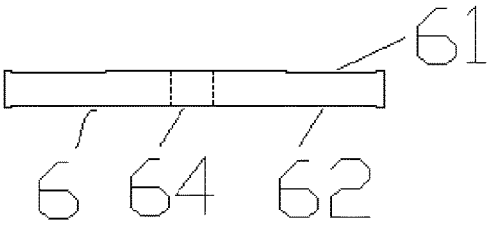
FIG. 5 is a top view of a metal connecting plate as shown in FIG. 4.

Before the metal connecting plate is welded with the dielectric resonant column, the prefabricated disc-shaped metal connecting plate needs to be machined; as shown in FIGS. 4 and 5, an annular groove is machined on the upper end surface of the metal connecting plate 6, a first circular groove is machined on the lower end surface of the metal connecting plate 6, and a threaded through hole 64 is machined in the center of the metal connecting plate. To ensure a good conductivity for the metal connecting plate, the metal connecting plate in the embodiment adopts a silver-coated sheet metal or a sheet copper.

After one end of the dielectric resonant column is metalized and the metal connecting plate is machined, the metalized end of the dielectric resonant column is placed in the annular groove on the metal connecting plate and is then welded with the metal connecting plate 6 into a whole in a certain environment. During the machining, the annular groove of the metal connecting plate should have a proper depth to ensure that no excess solder paste flows to the outside to pollute the surface of the metal connecting plate when the dielectric resonant column is placed in the annular groove of the metal connecting plate and is welded, so that the electrical performance of the dielectric resonator is not affected; furthermore, after the welding is completed, the contact plate between the dielectric resonant column and the metal connecting plate should be completely lower than the upper end surface of the metal connecting plate to facilitate the transmission of electromagnetic field.

Figure 6:
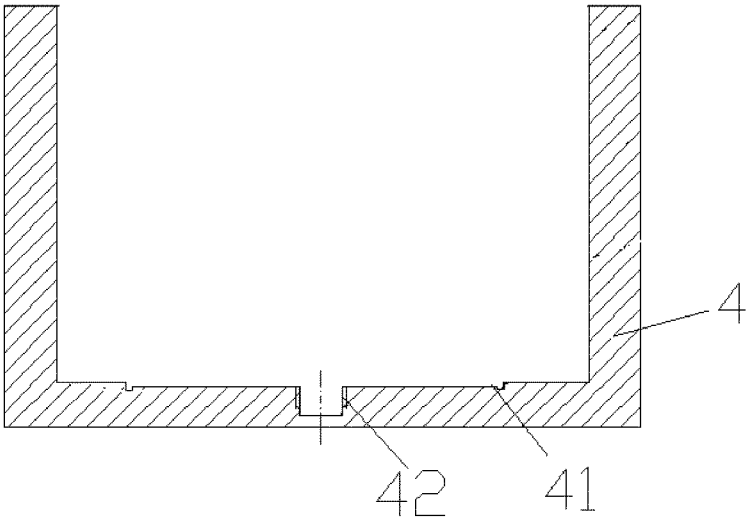
FIG. 6 is a diagram showing the structure of a metal cavity in a first embodiment of the present invention.

After the dielectric resonant column component with the metal connecting plate is machined, a metal cavity with an opening at one end is machined. As shown in FIG. 6, after an opening is machined at one end of the metal cavity, a second circular groove 41 matching the lower end surface of the metal connecting plate is machined on the inner wall of the bottom of the metal cavity opposite to the opening end; and a threaded hole 42 matching the threaded through hole 64 is machined on the inner wall of the bottom of the metal cavity.

After the dielectric resonant column component with the metal connecting plate and the metal cavity with an opening end are machined, the metal connecting plate of the dielectric resonant column component is aligned with the second circular groove of the metal cavity to be placed in the groove; and then the metal connecting plate of the dielectric resonant column component is fastened to the inner wall of the bottom of the metal cavity 4 by a screw 5 which passes through the threaded through hole on the metal connecting plate and the threaded hole on the metal cavity. Since the good contact of the contact surface between the metal connecting plate and the metal cavity can reduce the transmission impedance of electromagnetic wave and improve the electrical performance, when the second circular groove is machined on the metal cavity, the dent depth of the middle part of the second circular groove should be less than the dent depth of the circumference of the second circular groove, namely, the second circular groove is of a reversed concave shape, thus, the contact surface between the metal connecting plate and the metal cavity is a surface of which the two ends are higher than the middle part when the metal connecting plate is placed in the groove.

After the dielectric resonant column component with the metal connecting plate is fastened to the inner wall of the metal cavity, the opening end of the metal cavity 4 is covered with a prefabricated cover plate 2, and a prefabricated tuning screw 1 is screwed from the upper part of the cover plate 2 into the metal cavity for a certain length, so as to form a sealed TM dielectric resonator.

Figure 3:
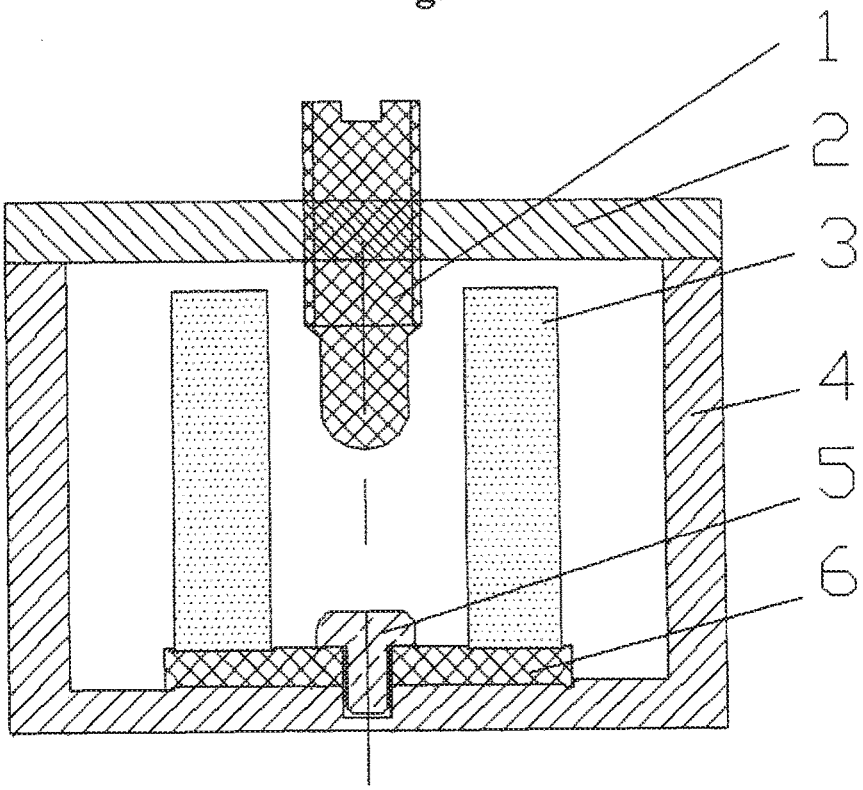
FIG. 3 is a diagram showing the structure of a TM dielectric resonator in a first embodiment of the present invention.

An embodiment of the present invention further provides a TM dielectric resonator machined by the method above, as shown in FIG. 3, which includes a metal cavity 4 with an opening at one end, a dielectric resonant column component which is provided with a metal connecting plate and is placed in the metal cavity 4, a screw 5 which fastens the dielectric resonant column component to the inner wall of the metal cavity 4, a cover plate 2 which covers the opening end of the metal cavity 4 to seal the inner part of the metal cavity, and a tuning screw 1 which is screwed from the cover plate 2 into the metal cavity 4.

The dielectric resonant column component with the metal connecting plate includes: a disc-shaped metal connecting plate 6 which is a silver-coated sheet metal or a sheet copper, wherein an annular groove 61 and a first circular groove 62 are formed on the upper end surface and the lower end surface of the dielectric resonant column component respectively and a threaded through hole 64 is formed in the center of the dielectric resonant column component, and a cylindrical dielectric resonant column 3 welded inside the annular groove 61, wherein one end of the dielectric resonant column 3 contacting with the metal connecting plate 6 is metalized.

In the embodiment of the present invention, a second circular groove is formed on the inner wall of the bottom of the metal cavity 4 opposite to the opening end and matches the lower end surface of the metal connecting plate; and a threaded hole matching the threaded through hole 64 is formed on the inner wall of the bottom.

Preferably, the dent depth of the middle part of the second circular groove is less than the dent depth of the circumference of the second circular groove, namely, the second circular groove is of a reversed concave shape.

An embodiment of the present invention further provides a TM dielectric filter formed by connecting one or more TM dielectric resonators.

Embodiment 2

In the embodiment, the step that a dielectric resonant column component with a metal connecting plate is machined may include:

one end of a prefabricated cylindrical dielectric resonant column 3 is metalized;

a cylindrical boss 63 which matches the inner surface of the dielectric resonant column 3 is machined on the upper end surface of the prefabricated disc-shaped metal connecting plate 6; and the metalized end of the dielectric resonant column 3 is sleeved on the outer surface of the cylindrical boss 63 and is welded with the metal connecting plate 6 into a whole.

Preferably, when the dielectric resonant column component with the metal connecting plate is machined, one end of the prefabricated cylindrical dielectric resonant column 3 needs to be metalized. During the metallization, a metal film may be coated at one end of the dielectric resonant column 3 by an electroplating method or in other methods in the prior art.

Figure 8:
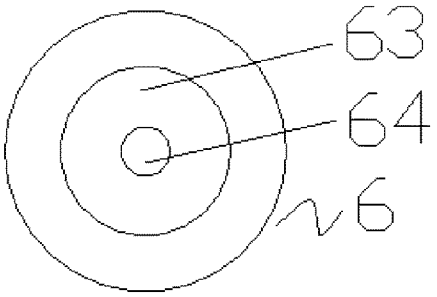
FIG. 8 is a diagram showing the structure of a metal connecting plate in a second embodiment of the present invention.
Figure 9:
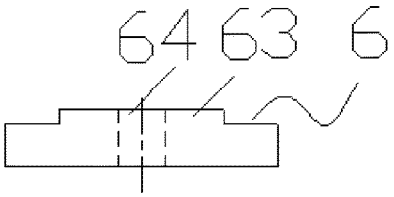
FIG. 9 is a top view of a metal connecting plate as shown in FIG. 8.

Before the metal connecting plate is welded with the dielectric resonant column, the prefabricated disc-shaped metal connecting plate needs to be machined. As shown in FIGS. 8 and 9, a cylindrical boss 63 is machined on the upper end surface of the metal connecting plate 6, and a threaded through hole 64 is machined in the center of the metal connecting plate. To ensure a good conductivity for the metal connecting plate, the metal connecting plate in the embodiment adopts a silver-coated sheet metal or a sheet copper.

After one end of the dielectric resonant column is metalized and the metal connecting plate is machined, the metalized end of the dielectric resonant column is sleeved on the outer surface of the cylindrical boss 63 and is further welded with the metal connecting plate 6 into a whole in a certain environment.

After the dielectric resonant column component with the metal connecting plate is machined, a metal cavity with an opening at one end is machined. After an opening is machined at one end of the metal cavity, a cavity groove matching the outer surface of the metal connecting plate is machined on the inner wall of the bottom of the metal cavity opposite to the opening end; and a threaded hole matching the threaded through hole of the metal connecting plate is machined on the inner wall of the bottom of the metal cavity.

Then, the metal connecting plate of the dielectric resonant column component is placed in the cavity groove of the metal cavity, the circumference of the dielectric resonant column is fixed on the inner wall of the bottom of the metal cavity in a welding way, and the metal connecting plate of the dielectric resonant column component is fastened on the inner wall of the bottom of the metal cavity 4 by a screw 5 which passes through the threaded through hole on the metal connecting plate and the threaded hole on the metal cavity in sequence.

After the dielectric resonant column component with the metal connecting plate is fastened on the inner wall of the metal cavity, the opening end of the metal cavity 4 is covered with a prefabricated cover plate 2, and the prefabricated tuning screw 1 is screwed from the upper part of the cover plate 2 into the metal cavity for a certain length, so as to form a sealed TM dielectric resonator.

Figure 7:
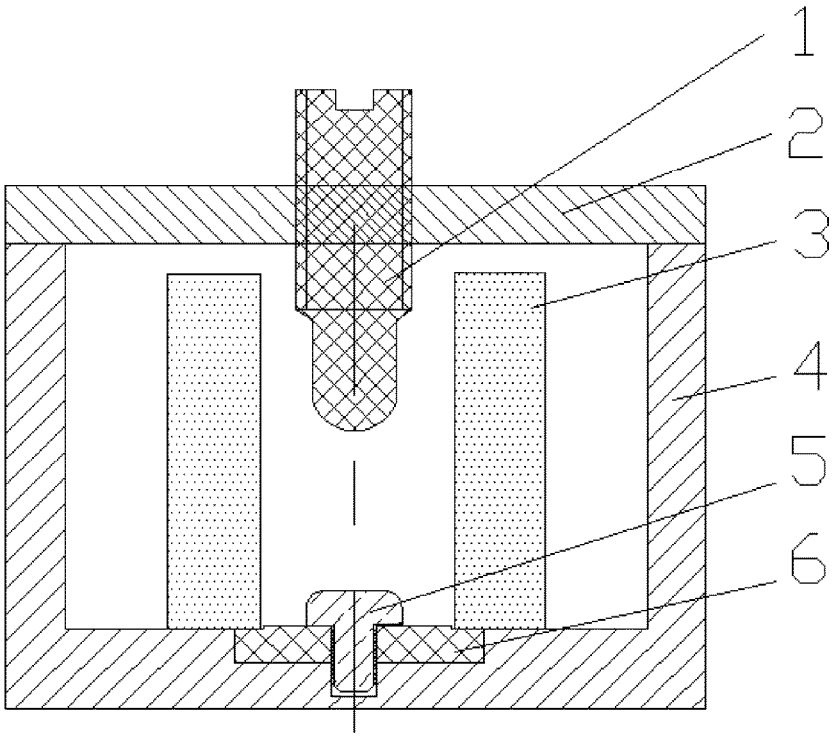
FIG. 7 is a diagram showing the structure of a TM dielectric resonator in a second embodiment of the present invention.

An embodiment of the present invention further provides a TM dielectric resonator machined by the method above, as shown in FIG. 7, which includes a metal cavity 4 with an opening at one end, a dielectric resonant column component which is provided with a metal connecting plate and is placed in the metal cavity 4, a screw 5 which fastens the dielectric resonant column component to the inner wall of the metal cavity 4, a cover plate 2 which covers the opening end of the metal cavity 4 to seal the inner part of the metal cavity, and a tuning screw 1 which is screwed from the cover plate 2 into the metal cavity 4.

The dielectric resonant column component with the metal connecting plate includes: a disc-shaped metal connecting plate 6 on the upper end surface of which a cylindrical boss 63 is formed, and a dielectric resonant column 3 which is sleeved on the outer surface of the cylindrical boss 63 and is welded with the metal connecting plate 6 into a whole, wherein one end of the dielectric resonant column 3 contacting with the metal connecting plate 6 is metalized.

In the embodiment of the present invention, a cavity groove is formed on the inner wall of the bottom of the metal cavity 4 opposite to the opening end and matches the outer surface of the metal connecting plate, so that the metal connecting plate can be placed in the groove completely; and a threaded hole matching the threaded through hole 64 is formed on the inner wall of the bottom.

An embodiment of the present invention further provides a TM dielectric filter formed by connecting one or more TM dielectric resonators.

In the embodiments 1 and 2, the steps of machining the dielectric resonant column component with the metal connecting plate and machining the metal cavity with an opening at one end can be adjusted as required, for example, the metal cavity with an opening at one end can be machined before the machining of the dielectric resonant column component with the metal connecting plate; or they are machined at the same time.

Although having been described in detail here, the present invention is not limited to this, and any modification can made by those skilled in the art according to the principle of the present invention, therefore, the modification made according to the principle of the present invention shall fall within the scope of protection of the present invention.

INDUSTRIAL APPLICABILITY

By applying the technical solution of the embodiments of the present invention to the field of the dielectric filter, the performance and service life of the TM dielectric resonator are improved, the volume of the resonator and the filter is effectively reduced, and the process is simple and easy to implement so as to be favourable for batch production and reduce the production cost; moreover, the effective transmission of field energy of the dielectric resonant column component is ensured, and the performance and operational reliability of the TM dielectric resonator are improved.

What is claimed is:

1. A method for implementing a TM dielectric resonator, comprising:

machining a dielectric resonant column component with a metal connecting plate;

machining a metal cavity with an opening at one end of the metal cavity;

fastening the metal connection plate of the dielectric resonant column component to an inner wall of the metal cavity by a screw;

covering the opening of the metal cavity with a prefabricated cover plate; and inserting a prefabricated tuning screw through the cover plate into the metal cavity;

wherein the step of machining a dielectric resonant column component with a metal connecting plate comprises:

metalizing one end of a prefabricated cylindrical dielectric resonant column;

machining an annular groove and a first circular groove on an upper end surface and a lower end surface of a prefabricated disc-shaped metal connecting plate respectively;

placing the metalized end of the dielectric resonant column in the annular groove and welding the dielectric resonant column with the metal connecting plate; and machining a second circular groove on the inner wall of the metal cavity which matches the lower end surface of the metal connecting plate.

2. The method according to claim 1, wherein a threaded hole which matches threads of the screw is further machined on the inner wall of the metal cavity.

3. A TM dielectric filter, comprising one or more TM dielectric resonators, wherein each of the one or more TM dielectric resonators comprises:

a metal cavity with an inner part having an opening at one end of the metal cavity;

a dielectric resonant column component which is provided with a metal connecting plate and is arranged in the metal cavity;

a screw which fastens the dielectric resonant column component to an inner wall of the metal cavity;

a cover plate which covers the opening of the metal cavity to seal the inner part of the metal cavity; and a tuning screw which is inserted through the cover plate into the metal cavity;

wherein the dielectric resonant column component with the metal connecting plate comprises:

a disc-shaped metal connecting plate, on the upper end surface and the lower end surface of which an annular groove and a first circular groove are formed, respectively; and a cylindrical dielectric resonant column welded inside the annular groove;

wherein one end of the dielectric resonant column is metalized and in contact with the metal connecting plate; and a second circular groove is machined on the inner wall of the metal cavity and matches the lower end surface of the metal connecting plate.

* * * * *